US010273864B2

(12) United States Patent
Takahashi et al.

(10) Patent No.: US 10,273,864 B2
(45) Date of Patent: Apr. 30, 2019

(54) ENGINE-DRIVEN GENERATOR

(71) Applicant: HONDA MOTOR CO., LTD., Tokyo (JP)

(72) Inventors: Yuki Takahashi, Wako (JP); Takuo Kase, Wako (JP); Kazuki Shimozono, Wako (JP); Kiyomi Yanai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 16 days.

(21) Appl. No.: 15/011,932

(22) Filed: Feb. 1, 2016

(65) Prior Publication Data

US 2016/0281581 A1 Sep. 29, 2016

(30) Foreign Application Priority Data

Mar. 26, 2015 (JP) ..... 2015-065018

(51) Int. Cl.
*F01P 1/06* (2006.01)
*F02B 63/04* (2006.01)
*F01P 5/06* (2006.01)

(52) U.S. Cl.
CPC ..... *F01P 1/06* (2013.01); *F01P 5/06* (2013.01); *F02B 63/044* (2013.01); *F02B 63/048* (2013.01)

(58) Field of Classification Search
CPC ..... F02B 63/04; F02B 63/48; F02B 63/44; F01P 1/06; F01P 5/06
See application file for complete search history.

(56) References Cited

U.S. PATENT DOCUMENTS 4,608,946 A * 9/1986 Tanaka ..... F01N 13/002 123/2
5,977,667 A * 11/1999 Hirose ..... F02B 63/04 290/1 B
6,028,369 A * 2/2000 Hirose ..... F02B 63/04 123/41.01
6,091,160 A * 7/2000 Kouchi ..... F02B 63/04 290/1 A
6,095,099 A * 8/2000 Morohoshi ..... F02B 77/13 123/2

(Continued)

FOREIGN PATENT DOCUMENTS

JP 57-126128 7/1982
JP H10-141088 5/1998

(Continued)

OTHER PUBLICATIONS

Willys-Overland Motors, Chassis and Lubrication Chart, 1941-42, Models 4-41 & 4-42.*

(Continued)

*Primary Examiner* — Hung Q Nguyen
*Assistant Examiner* — Xiao En Mo
(74) *Attorney, Agent, or Firm* — Rankin, Hill & Clark LLP

(57) ABSTRACT

An engine-driven generator includes a fuel tank disposed in front of a cooling fan, an air guide space defined between the fuel tank and the cooling fan, an inverter disposed beside a lateral side part of the air guide space, and an air shroud provided between the inverter and the air guide space. The fuel tank is vertically elongated to face a cylinder block of a vertical engine. A storage space having the inverter disposed therein is connected to the air guide space via the air shroud.

2 Claims, 8 Drawing Sheets

(56) References Cited

U.S. PATENT DOCUMENTS 6,431,126 B2 * 8/2002 Saito ..... F02B 63/04 123/2
6,781,262 B2 * 8/2004 Buening ..... H02K 9/06 310/263
6,784,575 B2 * 8/2004 Okuda ..... F02N 11/04 310/179
6,792,897 B2 * 9/2004 Higuchi ..... F02B 63/04 123/2
6,917,121 B2 * 7/2005 Akimoto ..... F02B 63/04 123/2
6,989,509 B2 * 1/2006 Silvestro ..... B23K 9/1006 219/133
6,992,265 B2 * 1/2006 Bender ..... B23K 9/1006 219/133
7,309,935 B2 * 12/2007 Braun ..... F04D 29/282 310/62
7,736,129 B2 * 6/2010 Matsuo ..... F04D 29/582 416/186 R
8,154,165 B2 * 4/2012 Yoshida ..... F02B 63/04 290/1 A
8,205,581 B2 * 6/2012 Hatsugai ..... F02B 63/04 123/41.56
8,210,133 B2 7/2012 Hirose et al.
8,222,753 B2 * 7/2012 Yoshida ..... F02B 63/04 290/1 A
2001/0011530 A1 * 8/2001 Saito ..... F02B 63/04 123/2
2003/0070651 A1 * 4/2003 Higuchi ..... F02B 63/04 123/300
2003/0183180 A1 * 10/2003 Wada ..... F02B 63/04 123/2
2004/0182846 A1 * 9/2004 Silvestro ..... B23K 9/1006 219/133
2009/0044769 A1 * 2/2009 Kubo ..... F01P 1/02 123/41.65
2009/0229544 A1 * 9/2009 Hatsugai ..... F02B 63/04 123/41.56
2009/0230697 A1 * 9/2009 Hatsugai ..... F02B 63/04 290/1 B
2010/0037837 A1 * 2/2010 Yamasaki ..... F01P 1/06 123/41.6
2011/0107985 A1 * 5/2011 Gorenflo ..... F02D 35/025 123/41.65
2012/0160194 A1 * 6/2012 Yano ..... F02F 1/34 123/41.65
2013/0319353 A1 * 12/2013 Bitzer ..... F01P 1/00 123/41.49
2014/0256245 A1 * 9/2014 Qian ..... F02B 63/044 454/251

FOREIGN PATENT DOCUMENTS

JP 2010-007599 1/2010
JP 2014-173461 9/2014
WO WO 00/10241 2/2000

OTHER PUBLICATIONS

Japanese Office Action with partial English translation dated Jun. 21, 2016, 5 pages.

* cited by examiner

ENGINE-DRIVEN GENERATOR

FIELD OF THE INVENTION

The present invention relates to an engine-driven generator configured to drive a generator unit by an engine and convert direct-current (DC) electric power generated by the generator unit into alternating-current (AC) electric power via an inverter.

BACKGROUND OF THE INVENTION

Some known engine-driven generators include a generator unit provided on one side of an engine in direct coupling with a crankshaft of the engine, and a fuel tank disposed on an opposite side of the engine. A typical example of such known engine-driven generators is disclosed in Japanese Patent Laid-open Publication (JP-A) No. 59-15633. The engine-driven generators are generally equipped with an inverter by means of which direct-current (DC) electric power generated by the generator unit is converted into alternating-current (AC) electric power. Furthermore, the engine-driven generators include a cooling fan provided coaxially with the engine crankshaft for cooling the inverter, the engine, etc.

In the ordinary engine-driven generators, the inverter is located at a position facing the cooling fan for the purpose of cooling the inverter by the cooling fan. In other words, the engine, the generator unit, the fuel tank, the cooling fan and the inverter are arranged in the same direction. With this arrangement, a size or dimension of the engine-driven generator in a direction along the crankshaft is relatively large, which will hinder down-sizing of the engine-driven generator.

It is therefore an object of the present invention to provide an engine-driven generator which is capable of achieving down-sizing of the engine-driven generator while securing sufficient cooling of an inverter.

SUMMARY OF THE INVENTION

According to the present invention, there is provided an engine-driven generator comprising: a vertical engine having a cylinder disposed substantially vertically; a generator unit provided on a side of the engine from which a crankshaft of the engine projects outwardly; a cooling fan disposed on a side of the generator unit opposite to the engine for cooling the engine and the generator unit; a fuel tank disposed on a side of the cooling fan opposite to the generator unit and extending vertically so as to be opposed to the cylinder; an air guide space defined between the fuel tank and the cooling fan; an inverter disposed beside a lateral side part of the air guide space for converting a direct-current voltage generated by the generator unit into an alternating-current voltage; and an air shroud disposed between the inverter and the air guide space and connecting a space in which the inverter is disposed to the air guide space.

With this arrangement, the cylinder of the engine is disposed substantially vertically, and the fuel tank is disposed on that side of the cooling fan which is opposite to the generator unit. The fuel tank is vertically elongated to face the cylinder of the engine. The thus configured fuel tank is able to secure a large capacity. The fuel tank needs not to be disposed above the engine and, hence, a height dimension of the engine-driven generator can be reduced.

By virtue of the vertically disposed cylinder of the engine, a space is provided on a lateral side of the cylinder. The space is used for installation of the inverter, and the inverter is disposed beside the lateral side part of the air guide space. Furthermore, by virtue of the air shroud disposed between the inverter and the air guide space, the inverter can be cooled by the cooling fan. Cooling of the inverter by the cooling fan can thus be secured.

The inverter needs not to be disposed in front of the cooling fan and, hence, a length dimension of the engine-driven generator can be reduced. By virtue of a combination of the fuel tank disposed on a side of the cooling fan opposite to the generator unit, and the inverter disposed beside the lateral side part of the air guide space, downsizing of the engine-driven generator can be achieved.

Furthermore, by virtue of a combination of the vertically disposed cylinder of the engine and the fuel tank disposed on the side of the cooling fan opposite to the generator unit, it is possible to provide a space above the cylinder. The thus provided space is used to perform maintenance/inspection of an ignition plug.

Additionally, the air guide space for guiding air into the cooling fan is formed by and between the fuel tank and the cooling fan. Since the fuel tank is used to form the air guide space, this arrangement is able to obviate the need for a separate member used exclusively for forming the air guide space, and an increase in cost of the engine-driven generator can be suppressed.

Preferably, the fuel tank has a rear wall facing the cooling fan, and a guide protrusion formed on the rear wall to extend along an outer circumference of the cooling fan such that air, which has been guided from the air shroud into the air guide space, is guided by the guide protrusion toward an entire area of a front side of the cooling fan.

By virtue of the guide protrusion formed on the rear wall of the fuel tank for guiding air from the air guide space to the entire area of the front side of the cooling fan, the air introduced in the air guide space can eventually be blown efficiently from the cooling fan as a cooling air. As a consequence, a sufficient amount of air can be introduced into the inverter and the inverter can be properly cooled by the thus introduced air. The generator unit and the engine can be more properly cooled by the cooling air blown from the cooling fan.

DETAILED DESCRIPTION OF THE PREFERRED EMBODIMENT

Figure 1:
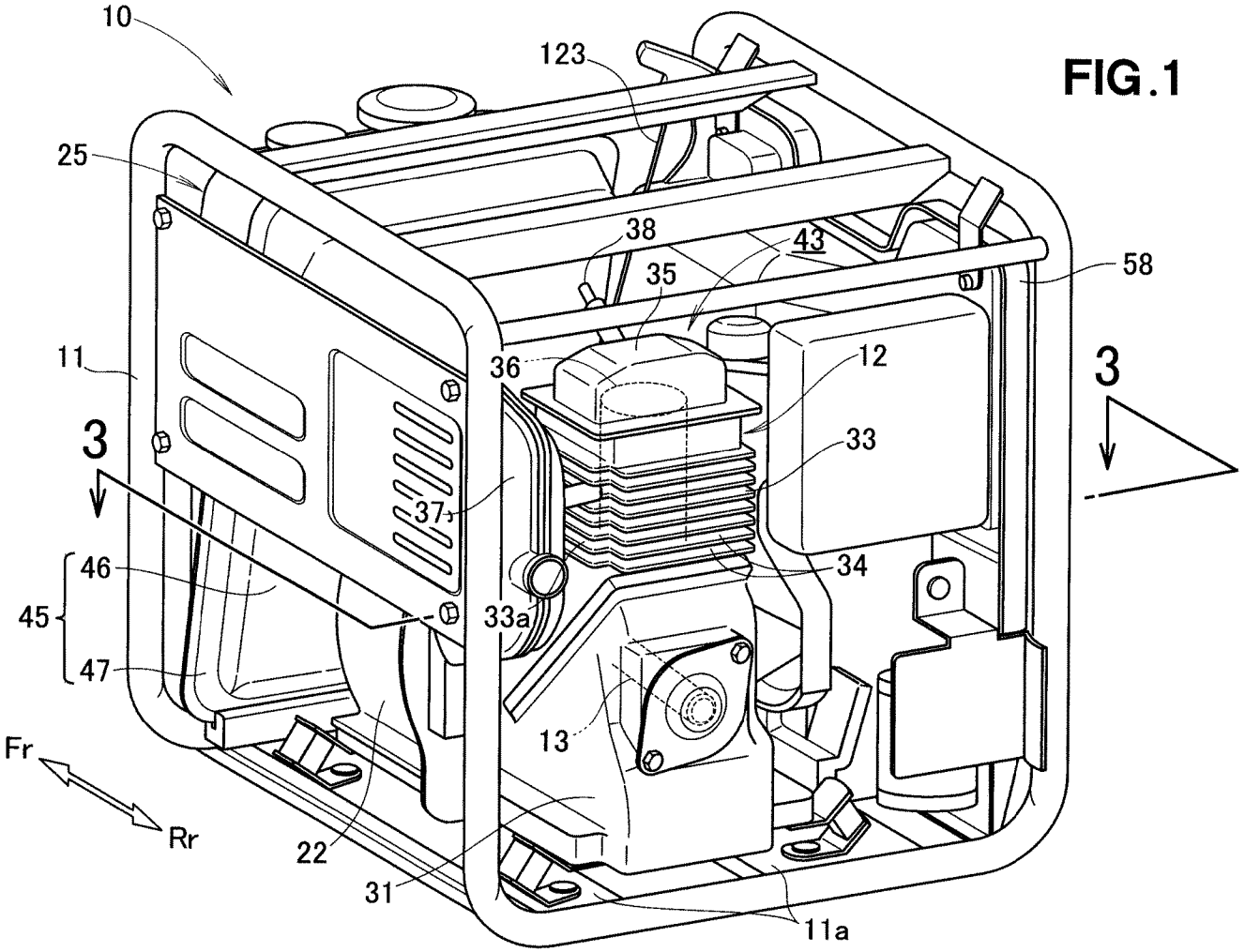
FIG. 1 is a perspective view of an engine-driven generator according to the present invention when viewed from an engine side thereof.

A certain preferred structural embodiment of the present invention will be described in greater details below, by way of example only, with reference to the accompanying sheets of drawings. In the drawings, "Fr" and "Rr" are used to refer to a front side or recoil cover side, and a rear side or engine side, respectively.

Figure 2:
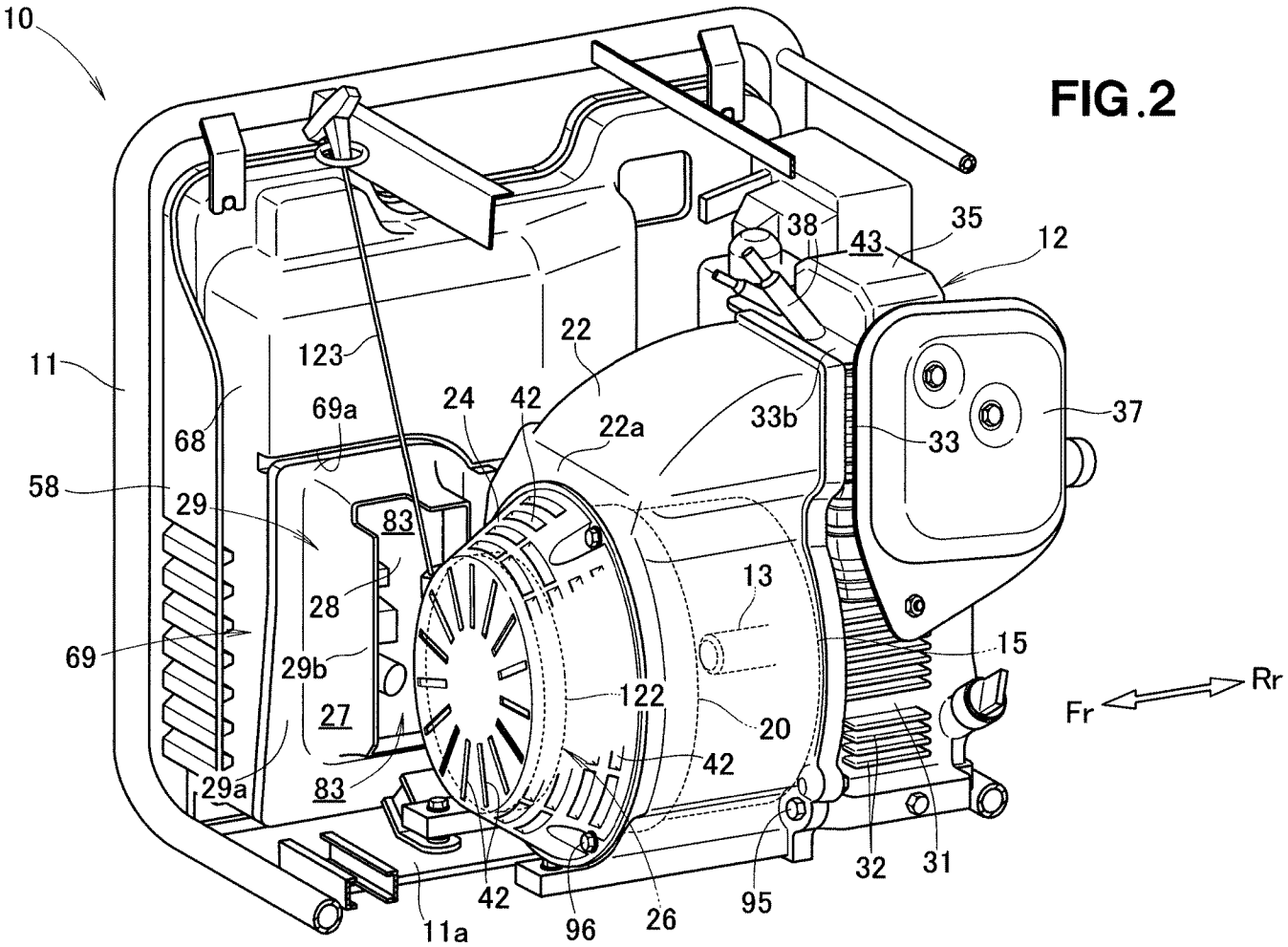
FIG. 2 is a perspective view of the engine-driven generator when viewed from a recoil cover thereof.

As shown in FIGS. 1 and 2, an engine-driven generator 10 embodying the present invention includes a vertical engine 12 mounted on a bottom 11*a* of a frame 11, a generator unit 15 provided in front of the engine 12, a cooling fan 20 provided in front of the generator unit 15, a fan cover 22 covering the cooling fan 20 and the generator unit 15, a recoil cover 24 attached to the fan cover 22, and a recoil starter 26 attached to the recoil cover 24.

Figure 3:
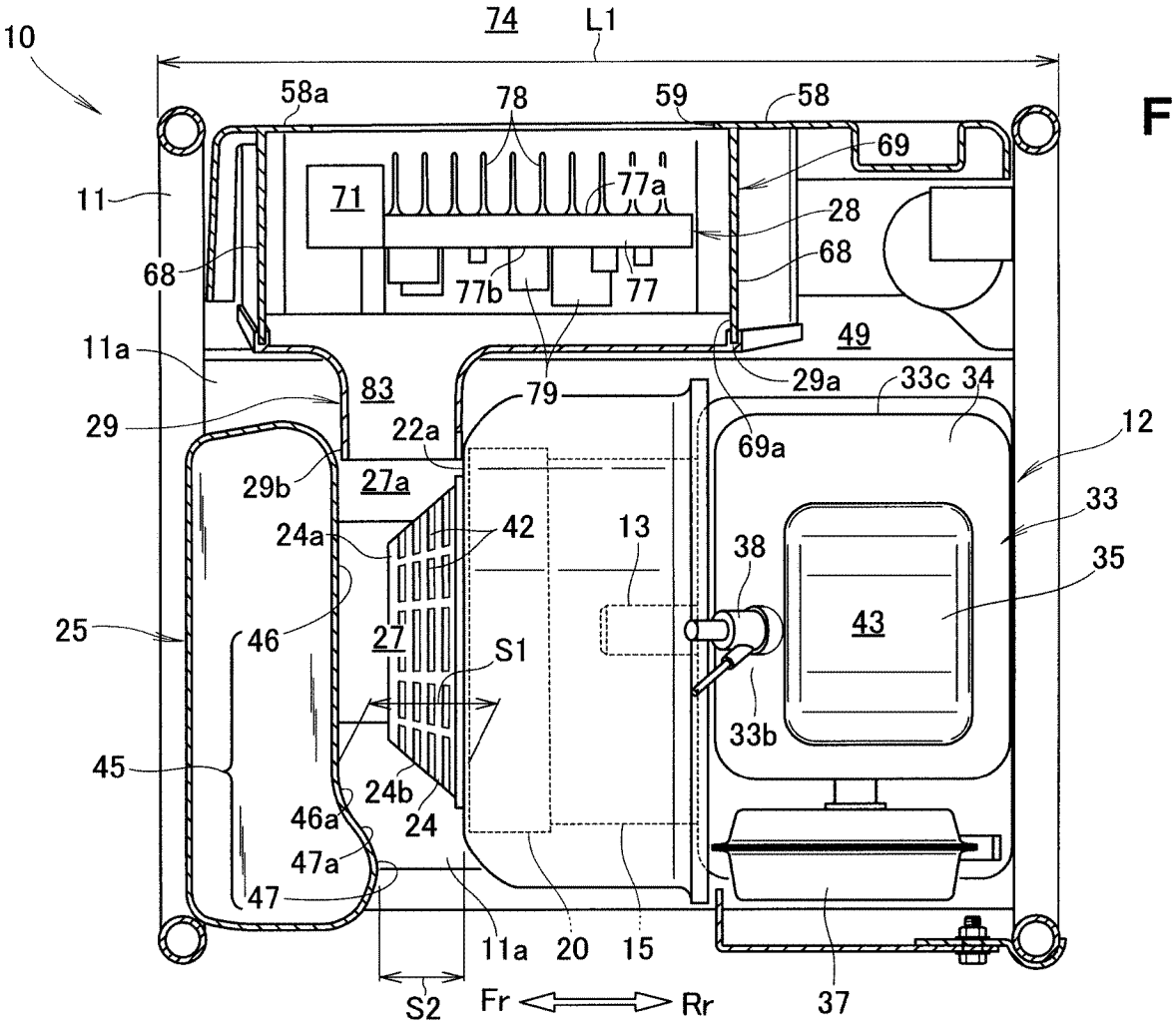
FIG. 3 is a cross-sectional view taken along the line 3-3 of FIG. 1.

As shown in FIG. 3, the engine-driven generator 10 further includes a fuel tank 25 provided in front of the recoil cover 24, an air guide space 27 defined between the fuel tank 25 and the recoil cover 24, an inverter 28 disposed beside one lateral side part 27*a* of the air guide space 27, and an air shroud 29 provided between the inverter 28 and the air guide space 27.

Referring back to FIG. 1, the engine 12 includes a crankcase (lower part of a barrel) 31 on which a crankshaft 13 is rotatably supported, a cylinder block (upper part of the barrel) 33 formed on an upper part of the crankcase 31, a head cover 35 covering an upper end portion of the cylinder block 33, and an exhaust muffler 37 provided adjacent to one side part 33*a* of the cylinder block 33.

The crankcase 31 has a series of cooling fins 32 (FIG. 2) formed on an outer surface thereof. Similarly, the cylinder block 33 has a series of cooling fins 34 formed on a peripheral wall thereof. The cylinder block 33 has a cylinder 36 formed therein. The cylinder 36 and the cylinder block 33 are disposed substantially vertically so that the engine 12 is a so-called "vertical engine".

An ignition plug 38 is provided on an upper part 33*b* (FIG. 3) of the cylinder block 33. The ignition plug 38 ignites a fuel (air-fuel-mixture) within a combustion chamber. The exhaust muffler 37 is located on a lateral side (more concretely, the lateral side 33*a*) of the engine 12.

Because of the cylinder 36 and the cylinder block 33 disposed substantially vertically, the size in a width direction of the engine 12 can be reduced. Furthermore, by virtue of the exhaust muffler 37 disposed on the lateral side 33*a* of the cylinder block 33, it is possible to suppress protrusion of the exhaust muffler 37 toward the outside. Size reduction of the engine 12 can thus be achieved.

As shown in FIG. 2, the crankshaft 13 projects forward from the engine 12, and the generator unit 15 is provided on that side of the engine 12 from which the crankshaft 13 projects. The generator unit 15 includes a stator and a rotor received inside the fan cover 22 with the rotor connected to a drive shaft of the generator unit 15. The drive shaft of the generator unit 15 is connected to the crankshaft 12 of the engine 12. By rotating the drive shaft by the crankshaft 13, the rotor rotates together with the drive shaft so that an electric voltage is supplied from the generator unit 15. The drive shaft of the generator unit 15 is connected to the cooling fan 20.

The cooling fan 20 is disposed on a front side of the generator unit 15 (which is a side of the generator unit 15 opposite to the engine 12). The cooling fan 20 is provided with a starter pulley. The recoil starter 26 has a locking pawl lockingly engageable with an engagement portion of the starter pulley. When the locking pawl is engaged with the engagement portion of the starter puller, rotation of the recoil starter 26 is transmitted via the locking pawl to the starter pulley. The starter pulley starts rotating together with the recoil starter 26, thereby rotating the cooling fan 20.

The cooling fan 20 and the generator unit 15 are covered by the fan cover 22. In this condition, the fan cover 22 is attached to a front part of the engine 12 by a plurality of bolts 95. The fan cover 22 is configured to ensure that cooling air blown from the cooling fan 20 is fed to the generator unit 15 and the engine 12 (particularly, the cylinder block 22 thereof).

The recoil cover 24 is attached to a front end portion 22*a* of the fan cover 22 by a plurality of bolts 96. The recoil starter 26 includes a recoil pulley 122 rotatably supported on a rear side of the recoil cover 24, a cable 123 wound on the recoil pulley 122, and the locking pawl engageable with the cooling fan 20 (more concretely, the starter pulley).

When the cable 123 of the recoil starter 26 is pulled by a human operator, the recoil pulley 122 is rotated. Rotation of the recoil pulley 122 causes the locking pawl of the recoil pulley 122 to come into engagement with the starter pulley of the cooling fan 20 whereupon the starter pulley begins to rotate.

Rotation of the starter pulley is transmitted via the drive shaft of the generator unit 15 to the crankshaft 13, and upon rotation of the crankshaft 13, the engine 12 starts running. After start of the engine 12, rotation of the crankshaft 13 is transmitted to the drive shaft and the starter pulley of the cooling fan 20. Rotation of the starter pulley causes the locking pawl of the recoil pulley 122 to be disengaged from the starter pulley.

By being driven by the engine 12, the drive shaft of the generator unit 15 is rotating. Rotation of the drive shaft causes the rotor of the generator unit 15 to rotate to thereby generate DC electric power from the generator unit 15. The DC electric power generated by the generator unit 15 is converted into AC electric power by the inverter 28 (also see, FIG. 3). The thus converted AC electric power can be supplied from the engine-driven generator 10 to the outside.

Rotation of the starter pulley by the drive shaft causes the cooling fan 20 to rotate. Upon rotation of the cooling fan 20, cooling air fed from the cooling fan 20 is guided via the fan cover 22 into the generator unit 12 and the engine 12. The generator unit 15 and the engine 12 can thus be cooled by the cooling air fed from the cooling fan 20.

Rotation of the cooling fan 20 also causes the outside air to be drawn into the interior of the cooling fan 22 from a front side thereof (i.e., the air guide space 27). In this instance, because the air guide space 24 communicates with the inverter 28 via the air shroud 29, when the outside air is drawn from the air guide space 27 into the interior of the cooling fan 20, a stream of cooling air is generated around the inverter 28 and the inverter 28 is cooled by the thus generated cooling air stream.

As shown in FIG. 3, the fuel tank 25 is disposed in front of the front end portion 22*a* of the fan cover 22 with a space S1 defined therebetween. The cooling fan 20 is disposed adjacent to the front end portion 22*a* of the fan cover 22. The fuel tank 25 is disposed in front of the cooling fan 20 (on a side of the cooling fan 20 which is opposite to the generator unit 15), and the air guide space 27 is defined between the fuel tank 25 and the cooling fan 20.

The recoil cover 24 is provided on the front end portion 22*a* of the fan cover 22. The recoil cover 24 is located to face the air guide space 27. The recoil cover 24 has a plurality of openings 42 formed therein. The air guide space 27 is therefore held in fluid communication with the cooling fan 20 via the plurality of openings 42.

Figure 4:
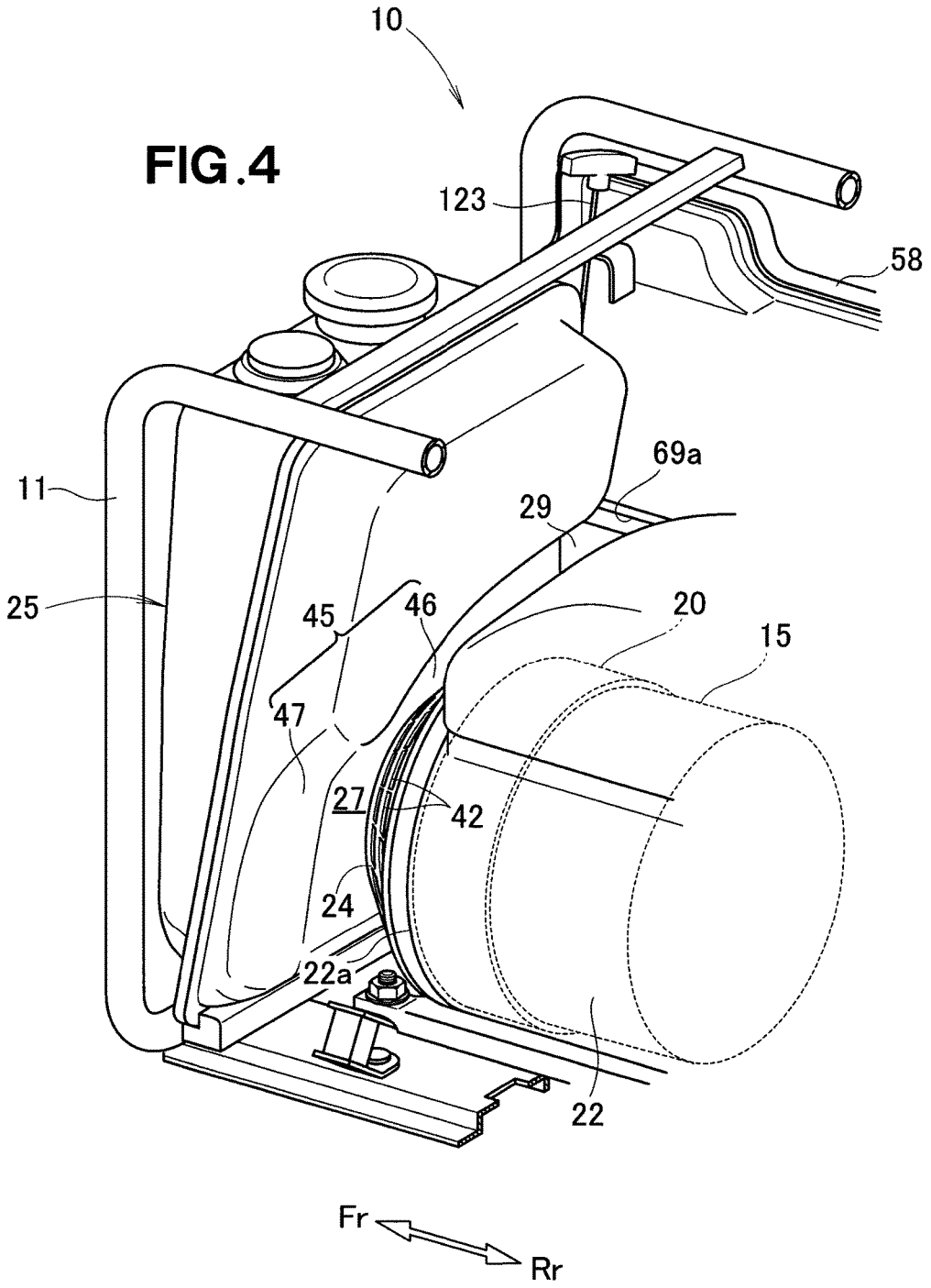
FIG. 4 is a perspective view of the engine-driven generator when viewed from a fan cover side thereof.

As shown in FIGS. 1 and 4, the fuel tank 25 disposed in front of the fan cover 22 extends vertically in opposed relation to the cylinder 36. The fuel tank 25 can thus be extended vertically to a height position coincidental with a height position of the head cover 35 of the engine 12. The fuel tank 25 can be enlarged in size in a height direction and, hence, is able to secure an enlarged capacity.

Furthermore, since the fuel tank 25 is disposed in front of the recoil cover 24, this arrangement obviates the need for arranging the fuel tank 25 above the engine 12 as done in the conventional engine-driven generators. The height dimension of the engine-driven generator 10 can thus be kept relatively small.

Additionally, since the cylinder block 33 of the engine 12 is disposed to rise substantially vertically and since the fuel tank 25 is disposed in front of the cooling fan 20, it is possible to keep a space 43 above the cylinder block 33. The space 33 thus provided above the cylinder block 33 is used to perform maintenance/inspection of the ignition plug 38.

Figure 5:
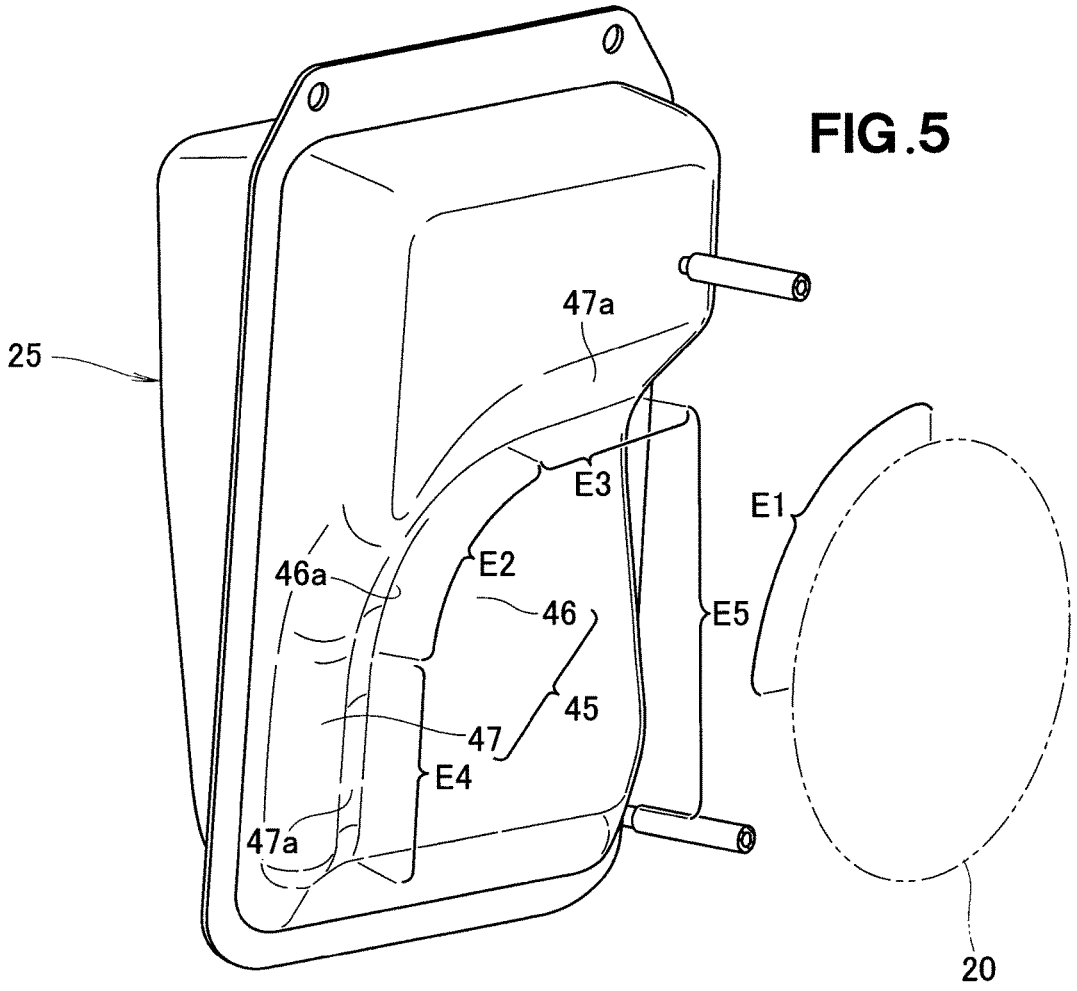
FIG. 5 is a perspective view of a fuel tank shown in FIG. 4.

As shown in FIGS. 3 and 5, the fuel tank 25 is formed into a vertically elongated rectangular shape and has a rear wall 45 facing the cooling fan 20. The rear wall 45 of the fuel tank 25 and the cooling fan 20 (more specifically, the fan cover 22) define therebetween the air guide space 27. The rear wall 45 of the fuel tank 25 includes a guide wall 46 formed substantially flat so as to face the cooling fan 20, and a guide protrusion 47 swelled from the flat guide wall 46 and extending in a substantially curved form along an outer peripheral edge 46*a* of the flat guide wall 46.

The guide wall 46 is arranged to face the front end portion 22*a* of the fan cover 22 with the space S1 defined therebetween. The guide wall 46 is arranged along a front face 24*a* of the recoil cover 24 and has the outer peripheral edge 46*a*. The outer peripheral edge 46*a* includes a curved region E2 shaped in a curved form along a region E1 (also see, FIG. 6) of the outer circumference of the cooling fan 20, a horizontal region E3 horizontally extending inward from an upper end of the curved region E2, and an outer vertical region E4 extending vertically downward from a lower end of the curved region E2. In other words, the curved region E2, the horizontal region E3 and the outer vertical region E4 of the outer peripheral edge 46*a* are formed substantially curvilinearly along the outer circumference of the cooling fan 20.

The guide protrusion 47 is swelled in a substantially curved form along the curved region E2, the horizontal region E3 and the outer vertical region E4 of the outer peripheral edge 46*a*. In other words, the guide protrusion 47 is swelled toward the cooling fan 20 and extends substantially curvilinearly along a part (hereinafter referred to as "opposing part") of the outer circumference of the cooling fan 20 which is opposed to the curved region E2, the horizontal region E3 and the outer vertical region E4 of the outer peripheral edge 46*a*.

With this arrangement, a distance S2 between the guide protrusion 47 and the opposing part of the cooling fan 20 can be reduced to a small value. Due to its swelled form, the guide protrusion 47 has a guide wall 47*a* formed on an inner side thereof. The guide wall 47*a* is formed along a side surface 24*b* of the recoil cover 24 (more specifically, a part of the recoil cover 24 corresponding to the opposing part of the cooling fan 20).

As previously described, the guide wall 46 is arranged along the front face 24*a* of the recoil cover 24, and the inner guide wall 47*a* of the guide protrusion 47 is arranged along the side surface 24*b* of the recoil cover 24. With this arrangement, the air guide space 27 defined between the rear wall 45 of the fuel tank 25 and the fan cover 22 is formed to extend along the front face 24*a* of the recoil cover 24 and the side surface 24*b* of the recoil cover 24 (more specifically, the part corresponding to the opposing part of the cooling fan 20).

Furthermore, that part of the side surface 24*b* of the recoil cover 24, which faces an inner vertical region E5 (FIG. 5) of the outer peripheral edge 46*a*, is disposed to face a communication space 83 via the lateral side part 27*a* of the air guide space 27.

With this arrangement, upon rotation of the cooling fan 20, the air inside the air guide space 27 can be effectively sucked or drawn into the cooling fan 20 via the openings 42 of the recoil cover 24. As the air in the air guide space 27 is thus sucked from the openings 42 of the recoil cover 27, the air inside the communication space 83 is sucked or drawn into the air guide space 27 via the lateral side part 27*a* of the air guide space 27.

Figure 6:
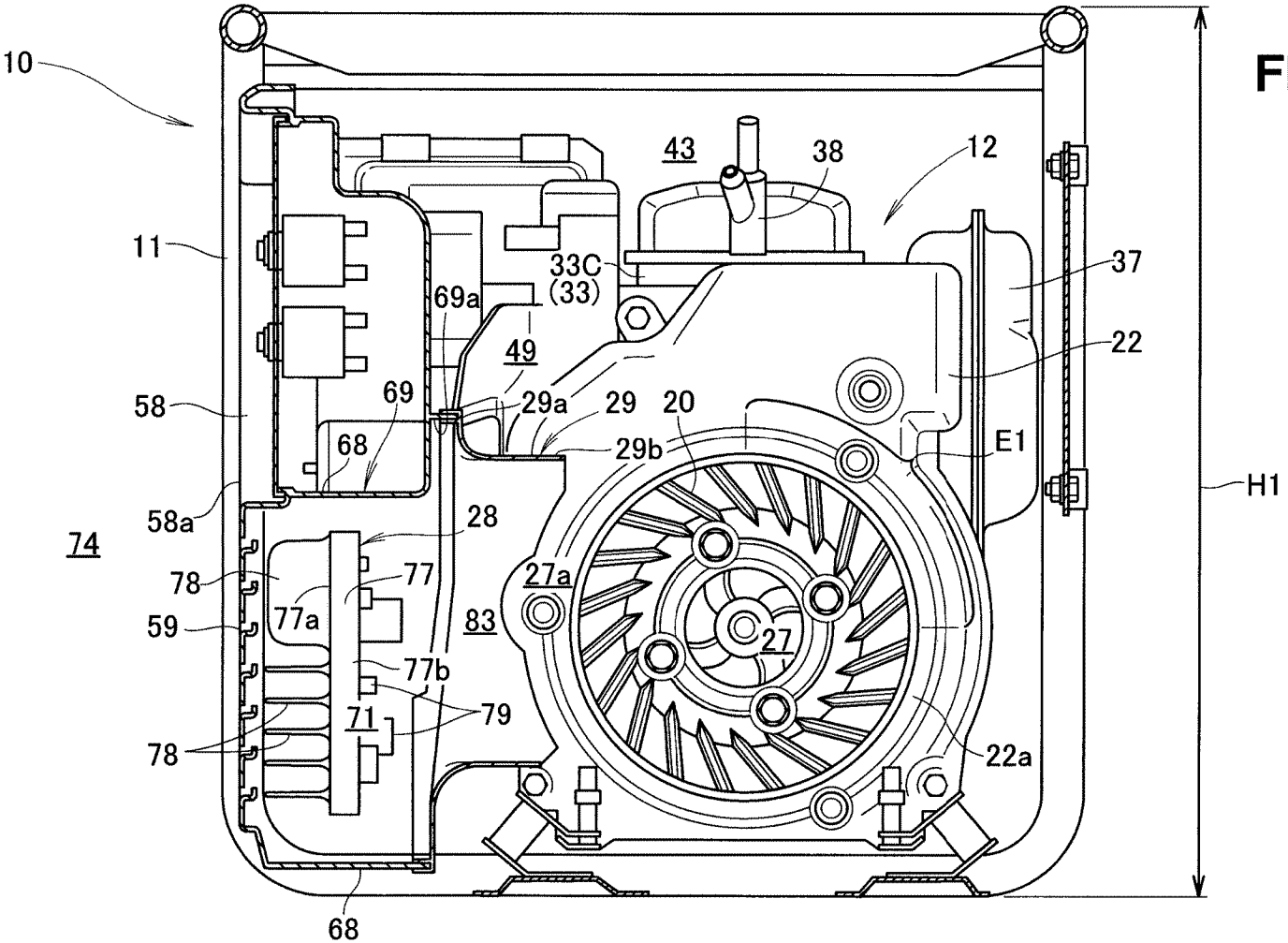
FIG. 6 is a front elevational view of the engine-driven generator shown in FIG. 2 with the recoil cover removed.

As shown in FIGS. 3 and 6, the cylinder block 22 of the engine 13 is disposed to rise substantially vertically, and with this arrangement, it is possible to keep a space 49 on an opposite lateral side 33*c* of the cylinder block 33. The space 49 is used to mount the inverter 28. The inverter 28 can thus be located beside the lateral side part 27*a* of the air guide space 27. This arrangement obviates the need for providing the inverter 28 in front of the cooling fan 20 and, hence, a length dimension L1 of the engine-driven generator 10 can be reduced.

As mentioned earlier, because the fuel tank 25 is disposed in front of the fan cover 22, this arrangement can obviate the need for arranging the fuel tank 25 above the engine 12 as done in the conventional engine-driven generators. A height dimension H1 of the engine-driven generator 10 can thus be reduced.

Furthermore, since the inverter 28 disposed beside the lateral side part 27*a* of the air guide space 27, a further reduction in the length dimension L1 of the engine-driven generator 10 can be achieved. By thus reducing the height dimension H1 and the length dimension of the engine-driven generator 10, noticeable downsizing of the engine-driven generator 10 is achieved.

The inverter 28 is disposed beside the lateral side part 27*a* of the air guide space 27 (namely, within the space 49 provided on the opposite lateral side 33*c* of the cylinder block 33), and the inverter 28 is covered by a side cover 58. In a state where the side cover 58 is attached to the frame 11, the side cover 58 is arranged to face the inverter 28. The side cover 58 is provided with a louver 59 having a plurality of openings. The louver 59 is formed at a front lower part 58*a* of the side cover 58 such that the louver 59 is located at a position opposed to the inverter 28.

The side cover 58 has on its rear side a peripheral wall 68 formed to have a substantially rectangular cross-sectional shape. The peripheral wall 68 and the side cover 58 (more specifically, that part of the side cover 58 which is provided with the louver 59) together form a storage part 69. The storage part 69 has an internal storage space 71 and the inverter 28 is stored in the storage space 71.

The inverter 28 includes a base 77 provided along the louver 59, a plurality of fins 78 provided on a front surface 77*a* of the base 77, and semiconductor devices 79 provided on a rear surface 77*b* of the base 77. By the inverter 2, the DC electric voltage generated by the generator unit 15 is converted to the AC current voltage.

Since the fins 78 are provided on the front surface 77*a* of the base 77, they are disposed to face the louver 59 of the side cover 58. With this arrangement, the outside air introduced from the louver 59 can efficiently hit on the fins 78 so that the fins 78 are efficiently cooled by the outside air introduced from the louver 59. The storage space 71 in which the inverter 28 is stored is connected in fluid communication with the outside of the side cover 58 (more specifically, the outside 74 of the engine-driven generator 10) via the louver 59.

The storage part 69 has an open end 69*a*, and the air shroud 29 has a base 29*a* attached to the open end 69*a* of the storage part 69. The air shroud 29 is formed into a hollow rectangular cross-sectional shape defining the communication space 83 (also see FIG. 2) and has a tip end 29*b* projecting into the lateral side part 27*a* of the air guide space 27. With this arrangement, the storage space 71 is connected in fluid communication with the lateral side part 27*a* of the air guide space 27 via the communication space 83 of the air shroud 29. The storage space 71 stores therein the inverter 28 and, hence, the air shroud 29 is disposed between the inverter 28 and the air guide space 27.

The storage space 71 is connected via the louver 59 to the outside of the sider cover 58 (i.e., the outside 74 of the engine-driven generator 10). The outside 74 of the side cover 58 is connected in fluid communication with the lateral side part 27*a* of the air guide space 27 successively through the louver 59, the storage space 71 and the communication space 83. Furthermore, the air guide space 27 is arranged to contact the front end portion 22*a* of the fan cover 22, and the recoil cover 24 is attached to the front end portion 22*a* of the fan cover 22. The air guide space 27 is therefore connected to the cooling fan 20 via the openings 42 of the recoil cover 24.

With this arrangement, when the cooling fan 20 starts rotating, air inside the air guide space 27 is sucked or drawn through the openings 42 of the recoil cover 24 into the cooling fan 20. As the air inside the air guide space 27 is thus sucked into the cooling fan 20, air inside the storage space 71 is introduced into the air guide space 27 via the communication space 83. As the air inside the storage space 71 is introduced into the air guide space 27, air outside the side cover 58 is introduced via the louver 59 into the storage space 71. By thus introducing the outside air into the storage space 71, the inverter 28 disposed in the storage space 71 is cooled by the outside air.

The guide wall 46 of the rear wall 45 of the fuel tank 25 is arranged along the front face 24*a* of the recoil cover 24, the inner guide wall 24*b* of the guide protrusion 47 is arranged along the side surface 24*b* of the recoil cover 24, the air guide space 27 is formed along the front face 24*a* and the side surface 24*b* of the recoil cover 24. With this arrangement, upon rotation of the cooling fan 20, the outside air, which has been introduced from the communication space 83 of the air shroud 29 into the air guide space 27, is reliably guided to the entire area of a front side of the cooling fan 20.

The air introduced into the air guide space 27 can thus be efficiently sucked or drawn into the cooling fan 20, and the sucked air can be efficiently fed onto the fan cover 22. The cooling air fed to the fan cover 22 with high efficiency is able to cool the generator unit 15 and the engine 12 (more particularly, the cylinder block 33 thereof).

On the other hand, the outside air introduced in the air guide space 27 is efficiently sucked or drawn into the cooling fan 20 and this will ensure that the air outside the side cover 58 is smoothly introduced into the storage space 71 via the louver 59. The inverter 28 disposed in the storage space 71 can thus be properly cooled by the outside air. Cooling of the inverter 28 can be secured by the cooling fan 20.

The air guide space 27 for introducing the outside air into the cooling fan 20 is defined between the fuel tank 25 and the cooling fan 20. The fuel tank 25 is thus used to form the air guide space 27. This arrangement obviates the needs for a separate member used exclusively for forming the air guide space 27, and an increase in the manufacturing cost of the engine-driven generator 10 can be suppressed.

Figure 7:
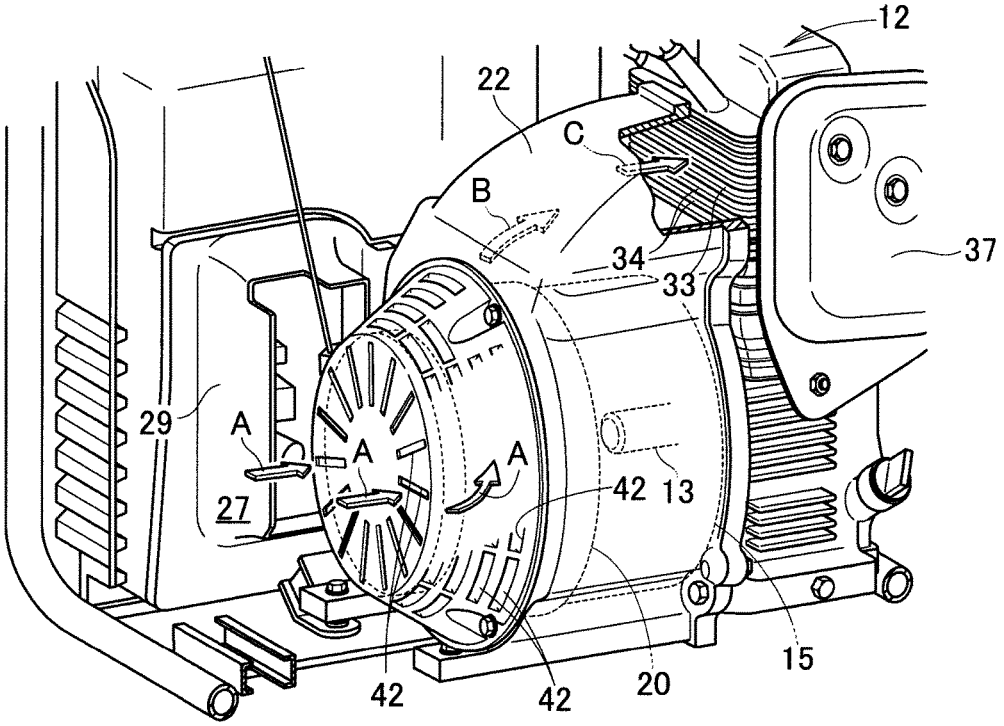
FIG. 7 is a view illustrative of the manner in which a generator unit and the engine of the engine-driven generator are cooled.

Referring next to FIG. 7, a description will be made about a manner in which the generator unit 15 and the engine 12 are cooled by the cooling fan 20. As shown in FIG. 7, rotation of the cooling fan 20 causes air inside the air guide space 27 to be sucked or drawn from the openings 42 of the recoil cover 24 toward the cooling fan 20 as indicated by arrows A. The air drawn into the cooling fan 20 is forcibly fed or blown, as cooling air, from the cooling fan 20 into the interior of the fan cover 22 as indicated by arrow B.

The cooling air introduced in the interior of the fan cover 22 cools the generator unit 15. The cooling air introduced in the interior of the fan cover 22 is subsequently introduced via the fan cover 22 toward the cylinder block 33 as indicated by arrow C. The generator unit 15 and the cylinder block 33 can thus be properly cooled by the cooling air introduced in the fan cover 22.

Figure 8:
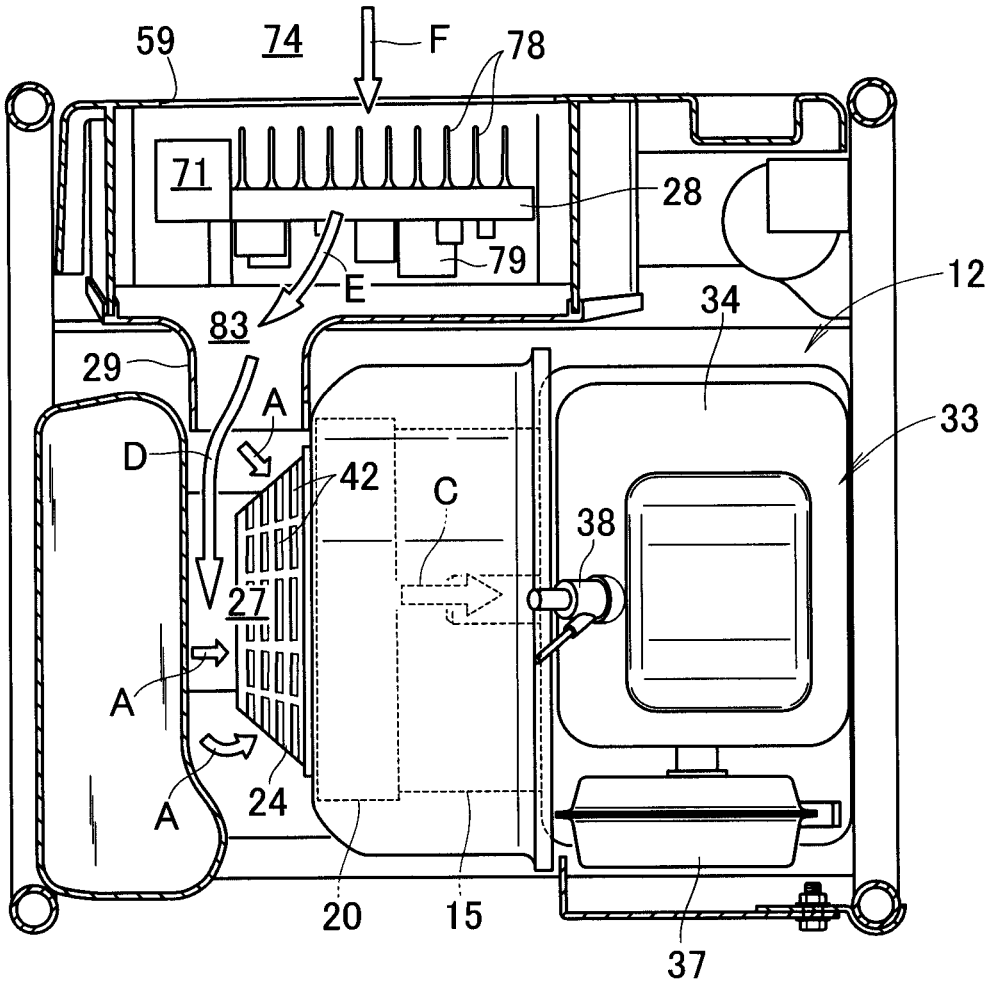
FIG. 8 is a view illustrative of the manner in which an inverter of the engine-driven generator is cooled.

Referring next to FIG. 8, a description will be made about a manner in which the inverter 28 is cooled by the cooling fan 20. As shown in FIG. 8, upon rotation of the cooling fan 20, air inside the air guide space 27 is sucked or drawn from the openings 42 of the recoil cover 24 toward the cooling fan 20 as indicated by arrows A. With the air inside the air guide space 27 thus sucked into the cooling fan 20, air in the communication space 83 is introduced into the air guide space 27 as indicated by arrow D.

As the air inside the communication space 83 is thus introduced into the air guide space 27, air inside the storage space 71 is introduced into the communication space 83 as indicated by arrow E. As a result of introduction of air from the storage space 71 to the communication space 83, the outside air is introduced from the outside 74 of the side cover 58 via the louver 59 into the storage space 71 as indicated by arrow F.

The inverter 28 is disposed in the storage space 71. By thus introducing the outside air into the storage space 71, the outside air comes into contact with the fins 78 of the inverter 28. With this cooling, heat generated from the base 77 and the semiconductor devices 79 is radiated from the fins 78. The inverter 28 can thus be cooled to a desired temperature.

The engine-driven generator according to the present invention should by no means be limited to the one shown the illustrated embodiment but various changes and modifications thereof are possible. For example, the shape and configuration of the engine-driven generator, the engine, the crankshaft, the generator unit, the cooling fan, the fan cover, the fuel tank, the air guide space, the inverter, the air shroud, the cylinder block, the cylinder, the fuel tank rear wall, the guide wall, the guide protrusion, and the storage space can be changed as appropriate without being limited to those shown in the illustrated embodiment.

The present invention is particularly suitable for an application to an engine-driven generator having a generator unit driven by an engine and an inverter provided for converting DC electric power generated by the generator unit into DC electric power.

Obviously, various minor changes and modifications of the present invention are possible in the light of the above teaching. It is therefore to be understood that within the scope of the appended claims the invention may be practiced otherwise than as specifically described.

What is claimed is:

1. An engine-driven generator comprising:

a vertical engine having a cylinder disposed substantially vertically and a crankshaft;

a generator unit provided on a side of the engine from which the crankshaft of the engine projects outwardly;

a cooling fan disposed on a side of the generator unit opposite to the engine for cooling the engine and the generator unit;

a fuel tank disposed on a side of the cooling fan opposite to the generator unit and extending vertically so as to be opposed to the cylinder;

an air guide space defined between the fuel tank and the cooling fan;

an inverter disposed beside a lateral side part of the air guide space for converting a direct-current voltage generated by the generator unit into an alternating-current voltage; and an air shroud disposed between the inverter and the air guide space and connecting a space in which the inverter is disposed to the air guide space, wherein the fuel tank includes a rear wall facing the cooling fan and located in front of the cooling fan to cover an entire area of a front side of the cooling fan, and a guide protrusion formed on the rear wall to extend along an outer circumference of the cooling fan such that air, which has been guided from the air shroud into the air guide space, is guided by the guide protrusion toward the entire area of the front side of the cooling fan, and an imaginary extension line that extends from the crankshaft in an axial direction of the crankshaft intersects the fuel tank, the rear wall of the fuel tank, and the cooling fan, with the imaginary extension line intersecting with the fuel tank and the rear wall of the fuel tank via the cooling fan, wherein the guide protrusion includes an outer peripheral edge, at least a portion of the outer peripheral edge of the guide protrusion being curved along a first dimension toward the cooling fan, the outer peripheral edge including a curved region shaped in a curved form along a second dimension different than the first dimension along a region of the outer circumference of the cooling fan;

a horizontal region horizontally extending inward from an upper end of the curved region; and an outer vertical region extending vertically downward from a lower end of the curved region, and wherein, during the cooling fan drawing air, the air passes the inverter, goes into the air guide space through the air shroud, and is directed to the cooling fan by a guide wall of the guide protrusion formed on the rear wall of the fuel tank.

2. An engine-driven generator comprising:

a vertical engine having a cylinder disposed substantially vertically and a crankshaft;

a generator unit provided on a side of the engine from which the crankshaft of the engine projects outwardly;

a cooling fan disposed on a side of the generator unit opposite to the engine for cooling the engine and the generator unit;

a fuel tank disposed on a side of the cooling fan opposite to the generator unit and extending vertically so as to be opposed to the cylinder;

an air guide space defined between the fuel tank and the cooling fan;

an inverter disposed beside a lateral side part of the air guide space for converting a direct-current voltage generated by the generator unit into an alternating-current voltage; and an air shroud disposed between the inverter and the air guide space and connecting a space in which the inverter is disposed to the air guide space, wherein the fuel tank includes a rear wall facing the cooling fan and located in front of the cooling fan to cover an entire area of a front side of the cooling fan, and a guide protrusion formed on the rear wall to extend along an outer circumference of the cooling fan, the guide protrusion being curved along a first dimension toward the cooling fan and a second dimension different than the first dimension along a region of the outer circumference of the cooling fan, and wherein, during the cooling fan drawing air, the air passes the inverter, goes into the air guide space through the air shroud, and is directed to the cooling fan by a guide wall of the guide protrusion formed on the rear wall of the fuel tank.

* * * * *